United States Patent [19]

Hutzel

[11] 4,057,140

[45] Nov. 8, 1977

[54] PHOTO-FINISHING PACKET WITH DATE STRIPS FOR PHOTOGRAPHIC PRINTS

[75] Inventor: Abraham Hutzel, Clinton, Md.

[73] Assignee: Cullen Photo Service, Inc., Alexandria, Va.

[21] Appl. No.: 680,372

[22] Filed: Apr. 26, 1976

[51] Int. Cl.[2] ..... B65D 77/24; B65D 85/30; B65D 27/08

[52] U.S. Cl. ..... 206/216; 206/455; 206/820; 229/72

[58] Field of Search ..... 206/223, 455, 456, 820, 206/216; 229/72

[56] References Cited

U.S. PATENT DOCUMENTS

| | | | |
|---|---|---|---|
| 2,681,732 | 6/1954 | Brady | 206/820 |
| 3,030,004 | 4/1962 | Pieronek et al. | 229/72 |
| 3,126,147 | 3/1964 | Froehlich | 229/72 |
| 3,182,791 | 5/1965 | Jenner | 206/820 |
| 3,361,252 | 1/1968 | Wise | 206/820 |
| 3,952,871 | 4/1976 | Erickson | 206/455 |

*Primary Examiner*—William T. Dixson, Jr.
*Attorney, Agent, or Firm*—Samuel Lebowitz

[57] ABSTRACT

An assembly for delivery to a customer upon completion of a photo-finishing operation, comprised of a packet envelope which includes not only the film negatives and the finished prints of the latter, but also one or more cards bearing date strips detachably affixed thereto with pressure sensitive adhesive, wherefrom they may be stripped easily and affixed individually to each of the prints at the front or back thereof, as desired by the customer. Thus, each print may be dated conveniently despite the lack of clear margins on the prints for automatically printing the date in this area or on the backs of the prints.

3 Claims, 6 Drawing Figures

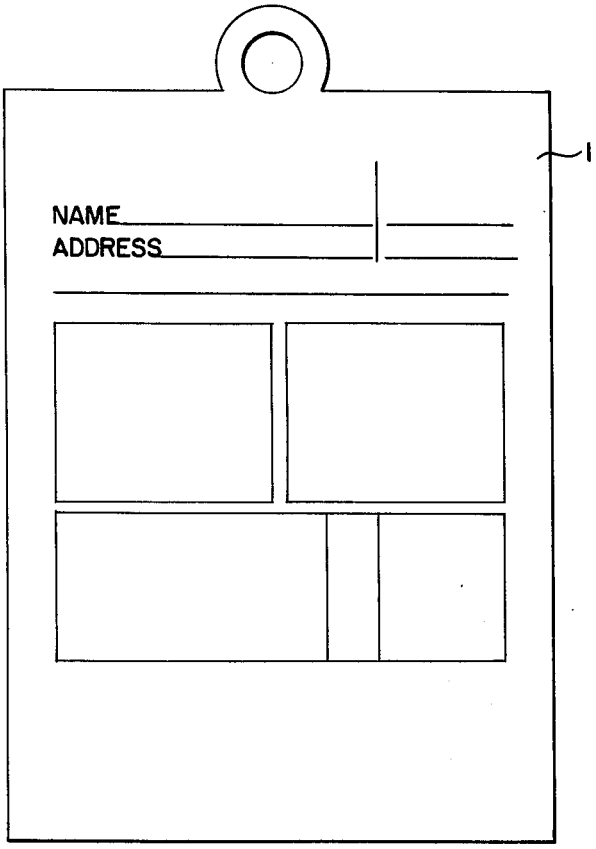
Fig. 1
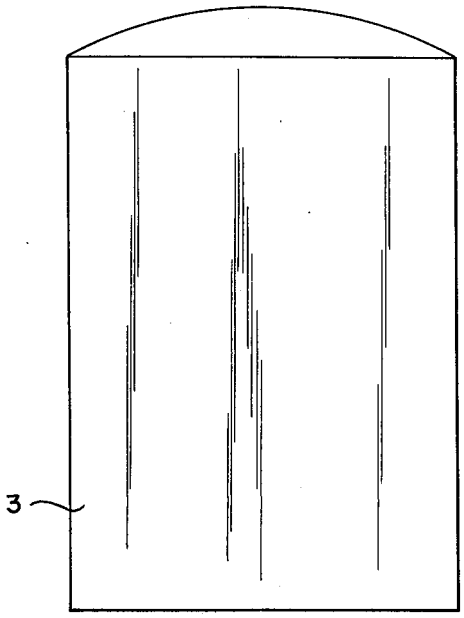
Fig. 2
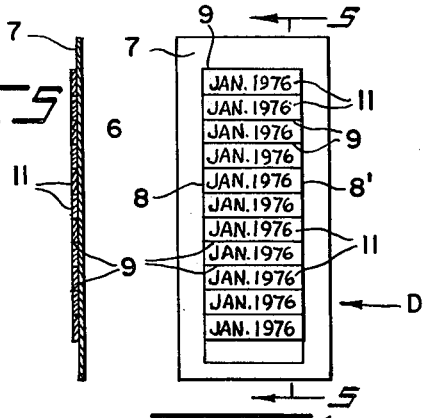
Fig. 5
Fig. 4
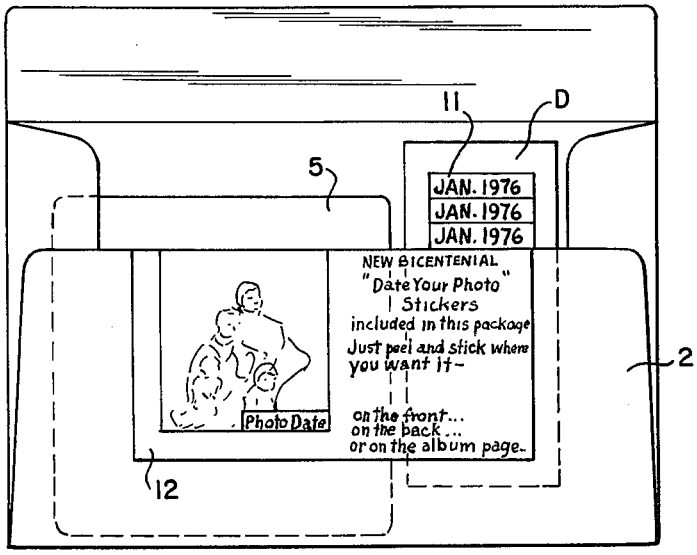
Fig. 3
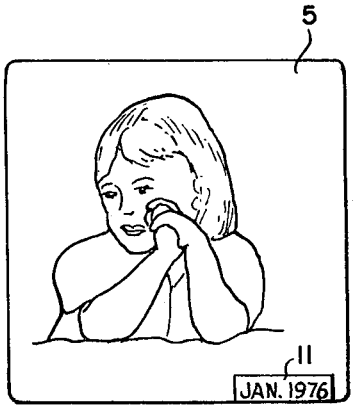
Fig 6

PHOTO-FINISHING PACKET WITH DATE STRIPS FOR PHOTOGRAPHIC PRINTS

This invention relates to a photo-finishing packet containing the completed pictures printed from the film strips which have been developed by the photo-finisher from the roll or cartridge of films which was furnished by the customer following its exposure.

It is the object of the present invention to enhance the quality of photo-finishing services by including, in the packet, a date strip comprised of a plurality of photo date labels which may be detached easily from a sheet of backing material and the individual date labels affixed to the individual photographs at any desired point thereof in order to provide a convenient date record of the photograph.

Recent photographic printing procedures have eliminated clear margin areas from printed photographs, which areas heretofore afforded a suitable location for the date imprint, such as the month and year, at the time of finishing the photograph. This change in printing techniques gave rise, in certain instances, to the imprinting of the date on the backs of the printed photographs, with attendant increasing costs. It is the object of the present invention to afford a degree of flexibility and judgment on the part of the customer to affix the date of the photograph to either a clear area on the front thereof, to the back thereof, or to the album page on which the photograph may be mounted. As commonly known, without the provision of such a convenient facility for dating the photographs, the same are stored or mounted without any date affixed thereto, and not until years later, does the customer realize the seriousness of this omission.

It is the object of the present invention to provide the customer with a facility for dating the photographs, which is of insignificant cost to the processer, but which adds immeasurably to the value of the service without need for resorting to the complex and costly procedures for printing the dates on the backs of the photographs.

Other objects and purposes will appear from the detailed description of the invention following hereinafter, taken in conjunction with the accompanying drawings, wherein FIG. 1 is a front view of a delivery and work envelope containing the various items produced in a photo-finishing service, including the inventive unit in accordance with the invention;

FIG. 2 is a front elevation of the negative envelope;

FIG. 3 is a rear view of the print envelope included in the photo-finishing delivery and work envelope shown in FIG. 1;

FIG. 4 is a front elevation of the sheet of photo date labels included in the print envelope;

FIG. 5 is a vertical sectional view on an enlarged scale along line 5—5 of FIG. 4; and FIG. 6 is a plan view of a photograph bearing a date label in accordance with the instant invention.

In the drawings is shown the delivery and work envelope 1 which may assume many different forms and which may be imprinted with any desired information which will render the finishing service rendered by the film processer both rapid and reliable. This envelope is not a part of the instant invention, but usually it bears a serial number, which is identical to that on a receipt which had been detached from the envelope and given to the customer at the time he left the exposed films for finishing. The front of the envelope may be imprinted with the name and address of the customer, his telephone number, the date of deposit of the films, and the store number identification where the same was left. The envelope may also contain several blank boxes, for additional information, such as identifying the film, whether the same is black and white or colored, etc., with identification of the film size, number of prints desired from each negative, and additional instructions, and, of course, the cost of the specific service.

The work envelope includes a smaller envelope 3, shown in FIG. 2, of generally translucent material for retaining the strips of the negative which have been developed from the exposed films, and for protecting them from marring or abrasion. Also contained within the delivery envelope 1 is the print envelope 2 shown in FIG. 3, which houses the finished photographic prints 5 in addition to one or more date sheets D in accordance with the invention. The print envelope may be printed decoratively and may bear timely advertising material, such as "Share Your Bicentennial Memories" with suitable Bicentennial designs. The back of the envelope may be imprinted with instructions to the customer in the use of the date sheet at the time he opens the envelope. These instructions may include again any supplemental advertising material which is especially pertinent to the period in which the photographs are printed, and presently they may feature the Bicentennial period in the following language, as shown in the panel 12 in FIG. 3:

NEW BICENTENNIAL

"Date Your Photo" Stickers included in this package.

Just peel and stick where you want it- on the front; on the back; or on the album page.

The date strip in accordance with the invention is shown in FIGS. 4 and 5 and comprises a unitary rectangular backing strip of paper of heavy stock or thin cardboard 6 which may be waxed on one of its surfaces and to which is affixed a strip of paper 7 bearing pressure sensitive adhesive on one face thereof in contact with the surface of the backing strip.

Labels provided with pressure sensitive adhesive which may be stripped from protective backings prior to their affixation to desired surfaces are well known in the art, for example, as shown and described in U.S. Pat. No. 2,267,945, Oct. 23, 1936.

The laminated date sheet D may be three and one-half inches long and one and one-half inches wide. Elongate incisions 8 and 8' are cut or scored in the strip 7 parallel to the long edges of the date sheet and transverse incisions 9 are cut in the strip between the long incisions 8,8' to subdivide the date strip into a plurality of panels 11, each of which is imprinted with the month and year of the photo-finishing operation. With a quarter-inch margin between the edge of the date sheet and the outer incisions in a date sheet of the above dimensions, twelve separable date strips may be had for affixation to the photo prints. The panels 11 may be conveiently separated from the backing strip 6 at any of the cuts 8, 8' and 9, or the intersections therebetween for immediate attachment to the prints. These date strips may be affixed to the front of the photograph as shown in FIG. 6, at some clear portion thereon, at the back thereof, and if desired, on the album page on which the photograhs may be mounted.

In the case of an order for multiple prints or those having more than twelve prints in the print envelope, several date strips D may be enclosed in the envelope 2.

I claim:

1. In a photo-finishing packet envelope containing a plurality of photographic negatives and prints thereof having the photographs covering the entire face of each photographic print, a unitary sheet of backing material and a strip of printed material coextensive with said sheet adhesively affixed with pressure-sensitive adhesive to one face of said backing material but readily strippable therefrom while retaining the adhesive on only the back face of said strip, said strip being scored incisively along a plurality of parallel lines to subdivide the strip into a plurality of small parts corresponding approximately in number to that of the photographic prints within the envelope, and with each part being imprinted identically with the date of the finishing operation, each of said small parts adapted to be affixed by the consumer, following its separation from the backing material, to a portion of each print to date the photograph for future reference.

2. A device as set forth in claim 1, wherein the incision lines of said strip are in the form of a plurality of cut rectangles, to separate the small parts into small rectangles, each bearing the month and year date of the photo-finishing operation, for ready affixation to the front or back of each photographic print.

3. A device as set forth in claim 2, wherein the unitary sheet of backing material and the coextensive superposed separable strip are of rectangular outline, with the major number of scoring incision lines in the latter extending parallel to the short sides of said rectangular strip and the two scoring lines perpendicular thereto displaced from the long margins of the sheet, to facilitate the individual stripping of the small parts from the backing material.

* * * * *